United States Patent [19]

Wuthrich

[11] Patent Number: 4,668,101

[45] Date of Patent: May 26, 1987

[54] WATER RESISTANT SEAL FOR WATCH CASE

[75] Inventor: Paul Wuthrich, Watertown, Conn.

[73] Assignee: Timex Corporation, Waterbury, Conn.

[21] Appl. No.: 800,859

[22] Filed: Nov. 22, 1985

[51] Int. Cl.[4] ..... G04B 37/00

[52] U.S. Cl. ..... 368/296; 368/294

[58] Field of Search ..... 368/294–296, 368/291–293

[56] References Cited

U.S. PATENT DOCUMENTS

| | | | |
|---|---|---|---|
| 2,854,815 | 10/1958 | Piquerez | 368/294 |
| 4,456,388 | 6/1984 | Matsumoto | 368/294 |
| 4,487,513 | 12/1984 | Matsumoto | 368/296 |

FOREIGN PATENT DOCUMENTS

| | | | |
|---|---|---|---|
| 1114244 | 4/1956 | France | 368/294 |
| 1386681 | 2/1964 | France | 368/286 |
| 82463 | 1/1977 | Japan | 368/294 |
| 313607 | 4/1956 | Switzerland | 368/296 |
| 473418 | 2/1969 | Switzerland | 368/286 |

*Primary Examiner*—Bernard Roskoski

*Attorney, Agent, or Firm*—William C. Crutcher

[57] ABSTRACT

An improvement in a water resistant seal for a watch case with a bezel having a peripheral wall and a lens having a peripheral edge. The wall has an inwardly protruding flange and the lens edge has an outwardly protruding flange, the flanges being diagonally offset from one another. An elastomeric gasket of L-shaped cross section is clamped between the lens and the bezel. The gasket has an upstanding leg deformed in opposite lateral directions, by the flanges with a shearing force across the gasket leg, and is dimensioned to provide clearances which allow for manufacturing variations in size of the lens and bezel, while still maintaining a water resistant seal.

8 Claims, 7 Drawing Figures

WATER RESISTANT SEAL FOR WATCH CASE

BACKGROUND OF THE INVENTION

This invention relates to an improved water reisitant seal for a watch case of the type having a lens with a peripheral edge to be sealed within a peripheral wall on the watch case bezel. More particularly, the invention relates to an improved water resistant seal using an elastomeric gasket.

Water resistant seals are well known which employ an elastomeric, or yielding, gasket which is forced between the peripheral edge of the watch lens or crystal and a groove in the bezel of the watch case to prevent moisture from entering the inside of the watch case. When the lens is circular, sealing is relatively easy to accomplish. However, sealing is much more difficult when the lens is rectangular or other non-circular shape. Variations in size due to normal manufacturing tolerances permissible in the lens or in the bezel become magnified in the event that a slightly oversized lens is assembled into a slightly undersized bezel opening, and vice versa. Watch designers have used a yieldable gasket to accomodate the variations. However, the compressive force on the gasket will also vary, leading to a leaking seal when an undersized lens is used with an oversized bezel opening. With very thin lenses of mineral glass or plastic, excessive pressures on the gasket to prevent leaking can lead to damage or breakage of the lens.

Prior art seals have been known which use elastomeric rings of circular cross section, which are squeezed in grooves between the edge of the lens and the bezel, sometimes being arranged to provide a downward force component on the lens to assist in the sealing. L-shaped gaskets are also known in which one leg of the "L" is compressed or squeezed radially or laterally between the bezel and the edge of the lens. The foregoing arrangements, however, are highly susceptible to variations in their effectiveness when the parts vary in size due to manufacturing tolerances.

Accordingly, one object of the present invention is to provide an improved water resistant seal which permits variations in component size due to manufacturing tolerances, while yet providing an effective seal.

Another object of the invention is to provide an improved water resistant seal using an L-shaped elastomeric gasket.

Other objects and advantages will become apparent by reference to the following description taken together with the accompanying drawings, in which:

FIGS. 1*a*–1*d* are horizontal elevation drawings, in cross section, showing typical prior art water resistant seals for watch cases, FIG. 2 is an enlarged horizontal cross-sectional drawing of the improved water resistant seal of the applicant, FIG. 3 is a similar horizontal elevation cross-section showing the parts in unassembled state.

FIG. 4 is a similar horizontal elevation cross-section showing a "worst case" condition in the assembled seal.

SUMMARY OF THE INVENTION

The invention comprises an improvement in a water resistant seal for a timepiece of the type including a lens with a peripheral edge having a first major transverse dimension, to be sealed inside a bezel with a peripheral wall having a second larger major transverse dimension, the major transverse dimensions being subject to variations due to manufacturing tolerances, wherein the improvement comprises a first peripheral flange on the lower edge of the lens protruding outwardly toward the peripheral wall, a second peripheral flange on the bezel wall protruding inward toward the edge of the lens, the peripheral flanges being offset in a diagonal direction from one another, and an L-shaped elastomeric gasket with an upstanding leg deformed by the flanges in opposite lateral directions with a shearing force across the gasket leg whereby manufacturing variations in the major transverse dimensions are accommodated.

DESCRIPTION OF THE PRIOR ART

FIGS. 1*a* through FIG. 1*d* depict typical constructions known in the art. In FIG. 1*a*, an L-shaped gasket 10 of synthetic resin, soft metal or synthetic rubber of radial elasticity is compressed between the peripheral edge of lens 11 and a peripheral wall of bezel 12. This seal is illustrated in U.S. Pat. No. 4,312,062 of Fujimori issued Jan. 2, 1979.

In FIG. 1*b*, a lens 13 has a peripheral rectangular groove 13*a*, and a bezel 14 has an opposed peripheral groove 14*a*. An elastomeric ring 15 of the circular cross section is compressed into groove 13*a* with an assembly tool, and allowed to expand into an ellipsoidal shape when the lens is assembled. This construction is illustrated in U.S. Pat. No. 3,505,807 of Piquerez issued Apr. 14, 1970.

FIG. 1*c* illustrates a similar arrangement, wherein a lens 16 has a peripheral groove 16*a* in its edge and a bezel 17 has a peripheral frustoconical wall 17*a*. A deformable elastomeric ring 18 is compressed and flattened between wall 17*a* and the edge of the crystal, forcing it downward against a dial 19 and holding it in place. This construction is illustrated in U.S. Pat. No. 3,545,197 of Fischer issued Dec. 8, 1970.

Lastly, FIG. 1*d* is shown in U.S. Pat. No. 3,676,997 issued July 18, 1972 to Fujimori. An L-shaped hard gasket, made of synthetic resin or soft metal, has a leg 20, which forms an acute angle with its other leg 21 in the unassembled state. The gasket is first stretched to the shape shown by inserting the peripheral edge of watch lens 22. Next, the gasket and crystal are deformed into position into a frustoconical groove 23*a* in the bezel 23.

The foregoing constructions serve to seal the edge of the crystal to the bezel by compressive force between two opposed surfaces. Therefore, variations in the major transverse dimensions of the bezel wall or the lens edge will vary the effectiveness of the seal.

DESCRIPTION OF THE PREFERRED EMBODIMENT

Figure 1A:
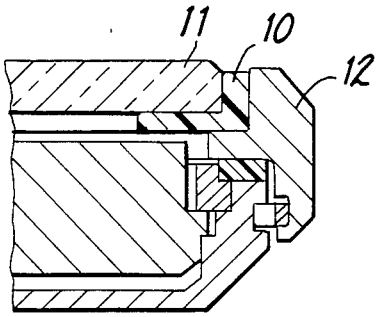
(PRIOR ART) FIG. 1a
Figure 1C:
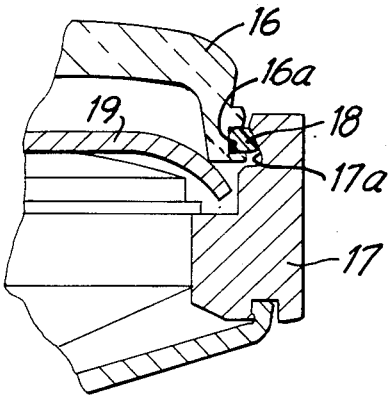
(PRIOR ART) FIG. 1c
Figure 1B:
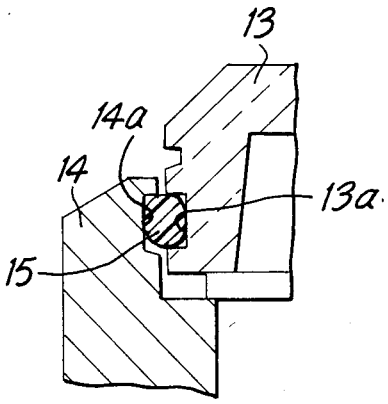
(PRIOR ART) FIG. 1b
Figure 1D:
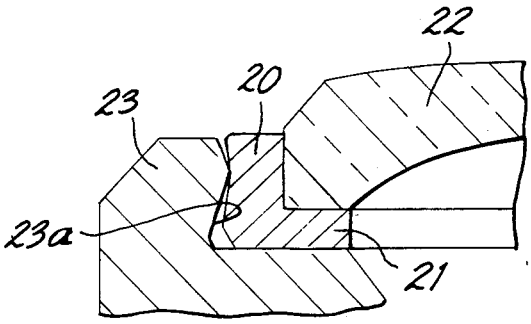
(PRIOR ART) FIG. 1d
Figure 2:
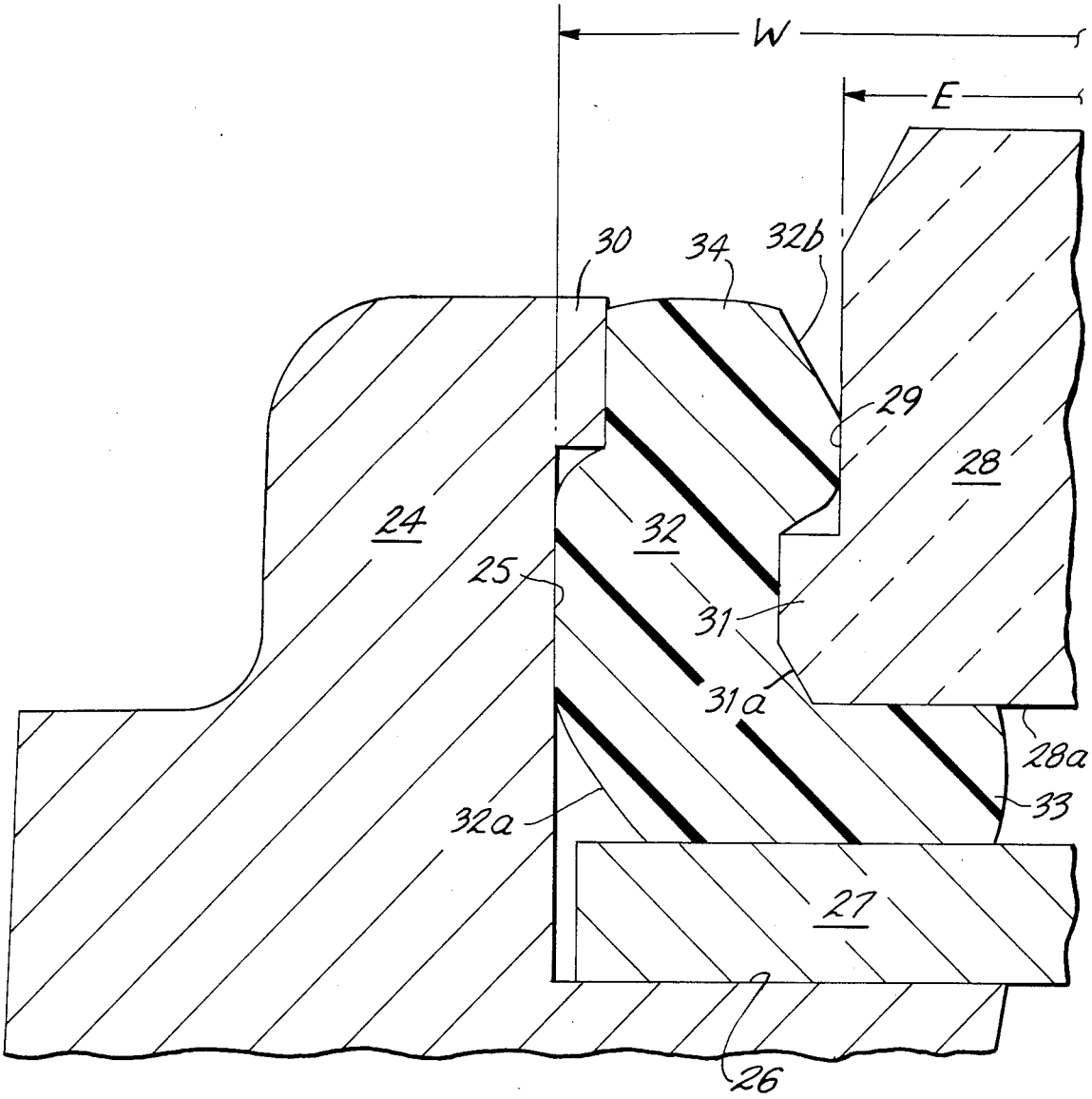

Referring to FIG. 2 of the drawing, a watch case includes a bezel 24 having a peripheral wall 25 and a shelf 26 upon which rests the edge of a watch dial 27. A transparent lens or crystal 28 has a peripheral surface designated as peripheral edge 29 which generally follows the contours of peripheral wall 25. In other words, if wall 25 is cylindrical, then peripheral edge 29 of the lens is also cylindrical, as would be the case in a circular lens. However, the invention is particularly useful for sealing a rectangular lens, in which case it is understood that wall 25 and wall 29 extend around the periphery of the lens at equal distances from one another.

At any location around the watch case, such as the one shown in the cross section of FIG. 2, the peripheral edge 29 of the lens has a first major transverse dimension E taken from the center of the lens, and the wall 25 has a second major transverse larger dimension W taken from the center of the bezel. These major transverse dimensions are subject to variations due to manufacturing tolerances. For example, a major transverse lens dimension might be allowed to vary +0.01 mm and a major transverse bezel wall dimension might be allowed to vary +0.02 mm, giving a worst case condition of 0.06 mm between large lens and small opening, or vice-versa.

The bezel 24 is provided with a peripheral flange 30 protruding directly inwardly toward wall 29. Lens 28 is provided with a peripheral flange 31 extending directly outwardly adjacent the base surface 28*a* of the lens toward the bezel peripheral wall 25. The flanges are diagonally offset as shown, rather than opposing one another. Flange 31 is provided with a frustoconical guide surface 31*a* for consisting in guiding the lens into position during assembly.

Disposed between the lens and bezel is an L-shaped elastomeric gasket 32 which is deformed into the shape shown during assembly. Gasket 32 includes a base leg 33 disposed between the lower edge 28*a* of the lens and the dial 27. However, it is understood that the leg 33 could equally well be disposed directly upon shelf 26 of the bezel. The thickness of base leg 33 is such that it positions lens peripheral flange 31 opposite the wall 25 of the bezel, and accordingly also locates the peripheral flange 30 of the bezel opposite the major transverse dimension of the lens, and offset diagonally from the peripheral flange of the lens.

The L-shaped gasket 32 has an upstanding leg 34 which is deformed outward near the base leg and inward near its free end, with a shearing force created by the diagonally offset flanges 30, 31. It remains to note that gasket 32 also includes a beveled surface 32*a* to provide clearance at the juncture of the legs 33, 34, and to facilitate assembly, and a beveled guide surface 32*b* to facilitate assembly and deformation of the gasket.

Figure 3:
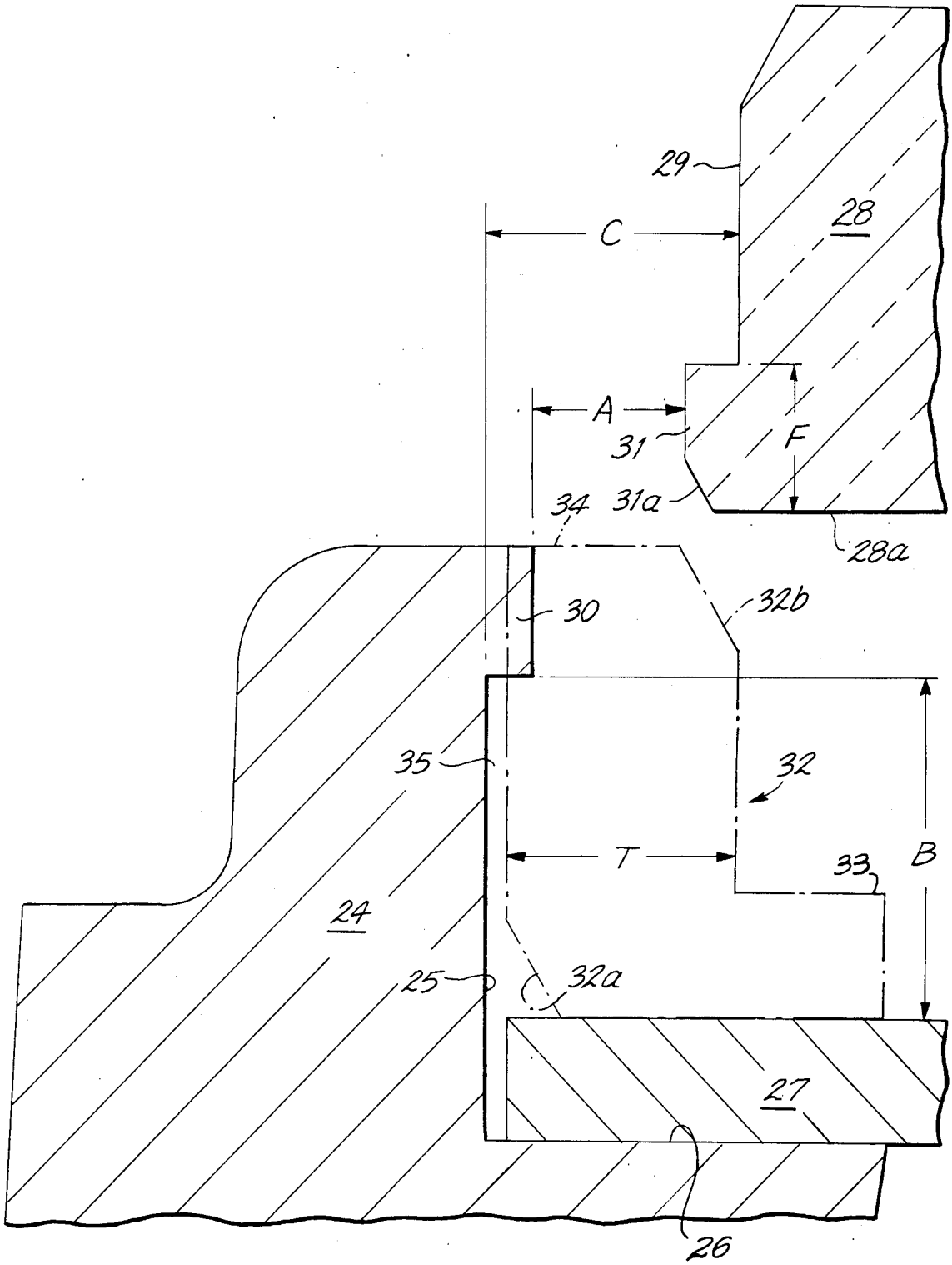

Reference to FIG. 3 of the drawing illustrates the components prior to assembly and the shape of the L-shaped gasket prior to deformation. The term "lateral" is used herein rather than "radial" and denotes a horizontal direction on the drawing. The lateral clearance between the peripheral flanges 30, 31 is shown at A. The larger lateral clearance between bezel wall and lens edge, (difference between the major transverse dimensions of the lens peripheral edge 29 and the bezel peripheral wall 25) is shown at C. Dimension A is preferably about half as great as dimension C. The axial space between bezel flange 30 and the dial 27 is indicated by B, while the axial dimension of the flange 31 on the lens is shown as F. Dimension B is preferably around twice as great as dimension F. The uncompressed thickness of the upstanding leg 34 of gasket 32 is shown as T, which is preferably selected so that it is slightly less than dimension C, but greater than the lateral clearance A between flanges. The outer dimension of gasket 32 in its undeformed condition may form a clearance space 35 with peripheral wall 25. The guide surfaces 31*a* on the lens and 32*b* on the gasket are dimensioned such that they engage when the lens 28 is forced downward and cause to exert an outward and downward force on the gasket into the clearance space 35. Gasket 32 is shown in phantom lines to illustrate the overlap of leg 34 with the bezel flange 30.

By way of illustration, and without intending to be in any way limiting, the following table gives typical dimensions for a rectangular watch lens approximately 25×27 mm.

A=0.30 mm
B=0.69 mm
C=0.51 mm
F=0.31 mm
T=0.48 mm

OPERATION

Figure 4:
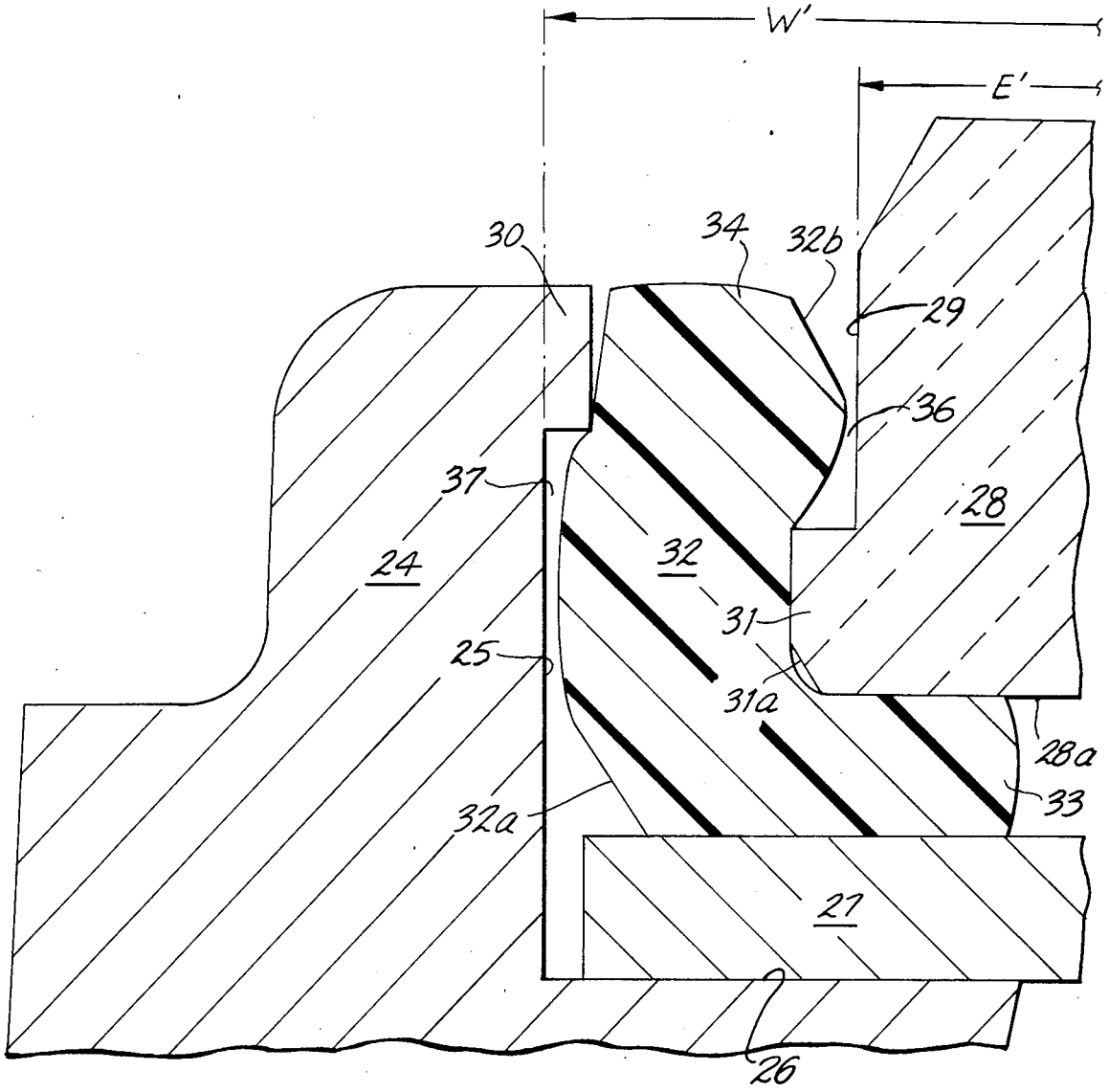

The operation of the invention will be apparent by reference to FIGS. 2, 3 and 4. Starting with the components as shown in FIG. 3, the gasket 32 is positioned, which due to the interference with flange 30 will commence to deform the upper end of leg 34 inward and the middle of leg 34 outward into clearance 35. As the lens 28 is pressed into position, the surfaces 31*a*, 32*b* engage and further distort gasket 32 into space 35. This action continues as flanges 30, 31 pass one another and as they clear one another, the upper end of leg 34 expands radially inward with a definite snap action engagement. This retains the lens in position and results in the configuration of upper leg 34 illustrated in FIG. 2. The lens flange 31 is positioned by the base leg 33 so as to be approximately centered on dimension B and a tight seal is maintained between flange 31 and wall 25, between flange 30 and wall 29, and between the diagonally offset sharp corners of the flanges by the opposed lateral shearing force exerted by the flanges.

FIG. 4 of the drawing illustrates a "worst case" condition where an undersized lens with major transverse dimensiion E′ is assembled with an oversized bezel opening having major transverse dimension W′. The reference numerals correspond to those of FIG. 2. As can be seen, a clearance space 36 can exist between the gasket leg 34 and lens edge 29, and a clearance space 37 can exist between gasket leg 34 and bezel wall 25 on the other side. Yet, because of the diagonally offset peripheral flanges 30, 31 exerting an opposing shearing force on the gasket leg, the water resistance seal maintains its integrity.

Due to the diagonally offset flanges 30, 31 the assembly is much more tolerant of variations in major transverse dimensions of the lens and the bezel. Clearances can exist at several places as shown in FIG. 4. An improved seal results without the necessity of trying to compress the full thickness of the gasket between the parts as in the prior art.

While there has been described what is considered to be the preferred embodiment of the invention, other modifications will occur to those skilled in the art, and it is desired to cure in the appended claims all such modifications as fall within the true spirit and scope of the invention.

I claim:

1. An improved water resistant seal for a watch case of the type including a lens with a peripheral edge having a first major transverse dimension and a bezel with an inner peripheral wall having a second larger major transverse dimension adapted to receive said peripheral edge, said major transverse dimensions being subject to variations due to manufacturing tolerances, said improvement comprising:

a first peripheral flange on said lens peripheral edge protruding directly outwardly toward said peripheral wall and defining a first sharp corner, a second peripheral flange on said bezel wall protruding directly inwardly toward said peripheral edge of the lens and defining a second sharp corner, said flanges having a lateral clearance therebetween and said first and second sharp corners being diagonally offset from one another, an elastomeric gasket having a base portion extending below the lens and positioning said first flange within the bezel and axially spaced from the second flange, said gasket also having an upstanding leg disposed between said flanges and deformed in opposite lateral directions due to shearing force exerted by said sharp corners of the diagonally offset flanges when the lens is positioned after insertion in the bezel.

2. The improvement, according to claim 1, wherein the thickness of the upstanding leg of the gasket in its unassembled state is greater than the lateral clearance between said flanges.

3. The improvement according to claim 1, wherein said first peripheral flange and said gasket upstanding leg define respectively aligned frustoconical guide surfaces adapted to engage and assist in deforming said upstanding leg in a lateral direction toward the bezel peripheral wall.

4. The improvement according to claim 1, wherein the axial distance from said second peripheral flange to the flower surface of the gasket base portion is substantially twice the axial dimension of said first peripheral flange.

5. The improvement according to claim 1, said bezel further defining a ledge beneath the base portion of the gasket, and having a timepiece dial interposed between said base portion and said ledge.

6. The improvement according to claim 1, wherein the lateral clearance between said first and second flanges is approximately half the lateral clearance between bezel wall and lens edge provided by said first and second major transverse dimensions.

7. The improvement according to claim 1, wherein said gasket is L-shaped in cross-section and wherein said base portion is a base leg forming a right angle with said upstanding leg.

8. An improved water resistant seal for a timepiece of the type including a lens with a peripheral edge having a first major transverse dimension and a bezel with an inner peripheral wall having a second larger transverse dimension adapted to receive said peripheral edge, said major transverse dimensions being subject to variations due to manufacturing tolerances, said improvement comprising:

a first peripheral flange on said lens peripheral edge protruding directly outwardly toward said peripheral wall and defining a first sharp corner, a second peripheral flange on said bezel wall protruding inwardly directly toward said peripheral edge of the lens and defining a second sharp corner and axially spaced from said first flange toward the outside of the timepiece, said flanges having a lateral clearance therebetween and said first and second sharp corners being diagonally offset from one another, and an elastomeric gasket having a leg disposed between said flanges and deformed in opposite lateral directions due to shearing force exerted by said sharp corners of the diagonally offset flanges when the lens is inserted in the bezel, the lateral thickness of said leg being greater in its unassembled state than the lateral clearance between said flanges when said variation in major transverse dimensions results in an undersized lens being matched with an oversized bezel wall, whereby the seal is maintained by shearing force caused by said flanges, despite manufacturing variances in lens and bezel.

* * * * *